US005351453A

United States Patent [19]

Leslie

[11] Patent Number: 5,351,453

[45] Date of Patent: Oct. 4, 1994

[54] RAPIDLY ERECTABLE HOUSING UNITS

[75] Inventor: Robert H. Leslie, Edina, Minn.

[73] Assignee: Home Builders International, Inc., Minneapolis, Minn.

[21] Appl. No.: 22,109

[22] Filed: Feb. 25, 1993

[51] Int. Cl.[5] ..... E04B 1/343

[52] U.S. Cl. ..... 52/270; 52/79.1; 52/284; 446/110

[58] Field of Search ..... 52/270 OR, 79.1, 285.2, 52/284, 285.4; 446/110, 111, 112, 113, 114, 119, 122, 123, 124, 127, 105, 108, 476

[56] References Cited

U.S. PATENT DOCUMENTS

| | | | |
|---|---|---|---|
| 2,600,900 | 6/1952 | McNeill | 52/270 |
| 3,299,594 | 1/1967 | Kellert | 52/270 |
| 4,055,924 | 11/1977 | Beaver, Jr. | 446/111 |
| 4,082,356 | 4/1978 | Johnson | 446/105 |
| 4,272,930 | 6/1981 | Foster | 52/79.1 |
| 4,464,877 | 8/1984 | Gebhardt et al. | 52/79.1 |
| 4,467,585 | 8/1984 | Busby | 52/79.1 |
| 4,523,418 | 6/1985 | McLaughlin | 52/284 |
| 4,569,664 | 2/1986 | Giampetruzzi et al. | 446/114 |

FOREIGN PATENT DOCUMENTS

| | | | |
|---|---|---|---|
| 0477325 | 9/1951 | Canada | 446/114 |
| 3512306 | 10/1986 | Fed. Rep. of Germany | 446/111 |
| 0534446 | 1/1922 | France | 446/110 |

*Primary Examiner*—Carl D. Friedman
*Assistant Examiner*—Wynn Wood
*Attorney, Agent, or Firm*—James R. Cwayna

[57] ABSTRACT

The invention of rapidly erectable housing units providing a number of properly shaped and interfitting wall sections. Beside the wall sections the units include interlocking or laid-uproofing applied to truss rafters. interlock to the erected walls. The wall sections are provided with structural base plates and headers for interlocking the walls into sturdy non-rackable condition to maintain the stability of the unit. The interfit of the wall sections may be in several forms such as matching, slotted grooves to afford sliding connection between sections and may also include mortise and tenon arrangements on the ends of sections with the tenon passing through the mortised area for the attachment of a locking element on the extending end of the tenon as well as the mortise position. The mortise and tenon arrangements, particularly at corner areas of the unit may include a plurality of interfitting elements rather than a single arrangement which will allow for more secure joining of the sections. The individual wall sections will include door and window openings which again afford slideable connective assembly and into which standard window and door units may be introduce. The units includes the conceept of using on site material for manufacture of all elements.

9 Claims, 4 Drawing Sheets

RAPIDLY ERECTABLE HOUSING UNITS

RELATED APPLICATIONS

There are no pending applications on file by the applicant which should be considered in association with the prosecution of this application.

FEDERAL SPONSORSHIP

This invention is not made under any Federally sponsored research and development arrangement nor any other sponsored research and development arrangement which should be noted.

FIELD OF THE INVENTION

This invention relates to rapidly erectable housing units which basically consist of a plurality of joinable wall sections which are lockable to each other to form the basic structure with openings provided for doors and windows and a roof structure which may be formed of individual sections interlockable with the placed vertical wall sections. The concept also includes the potential of on-site manufacture of the units.

SUMMARY OF THE INVENTION

This invention discloses the concept of rapidly erectable housing units which will probably find their highest useage in disaster areas or in low economic areas.

The invention provides housing units having vertically arranged exterior walls with interior partitions to form rooms.

The joinder system for the connection of the vertical wall sections includes several forms.

The first of these forms may be a vertically slideable arrangement wherein one wall section is provided with a slot extending from the upper surface thereof approximately one-half the vertical height of the section with the joining section being provided with a slot extending from the lower edge thereof to approximately one-half the vertical height of the section with the two elements being joined by sliding the two sections into and onto one another.

A second form of joinder would be what may be considered to be a partial mortise and tenon arrangement where one of the wall sections is provided with spaced slots and the other section being provided with a plurality of extensions which will slide through the formed slots of the first member. Locking members are then placed on the portions that extend through eacch other and are positively attached through such portions and to eachh other.

For partitions the slots may be provided at intermediate section locations.

A third form of joinder would be a single mortise and tenon arrangement where a single extension is formed on the end of one of the wall sections and a single slot is formed on the other wall section. After insertion of the extension through the slot a locking element is provided on the locking end of at least one of the walls.

Any of the mentioned joinder configurations structures is useable on any of the wall or partition sections for joining such sections into proper upright positioning.

The roof structure will provide supporting truss-type rafters with an over-layment of formed sections which are attachable to the trusses and the upper ends of the erected walls.

The wall sections are provided with openings therethrough which will provide for the doors and windows necessary to a housing unit and which are designed to receive readily available doors and windows.

Header and base plates may be provided to the walls for insuring strength features.

BACKGROUND AND OBJECTS OF THE INVENTION

Applicant is including with the filing of this application a Prior Art Statement. Basically this Prior Art Statement substantiates the applicant's belief that the unit and design thereof contains subject matter which is of patentable subject matter.

In disaster areas or in those areas of low income a need for inexpensive, quickly erected housing structures is of prime import- Very often in such situations there is no lack of labor but there is a lack of funding. Applicant's concept for rapidly erectable, inexpensive housing presents a solution to a these problems of immediate need at low cost.

It is therefore an object of the invention to provide rapidly erectable housing units wherein a number of wall sections are provided with interlockable connective arrangements to provide a non-rackable, vertical wall enclosure.

It is a further object of the invention to provide rapidly erectable housing units wherein a number of wall and partition sections are provided with slideable joinder arrangements which are thereafter locked in a manner to afford a non-rackable vertically arranged basic wall unit.

It is still a further object of the invention to provide a rapidly erectable housing unit which incorporates easily connectable side wall and interior partition sections with a supported roof therefore which incorporates structural supports for individual roof sections or a single roof section which roof sections again are interlockable to one another and the vertical wall sectons.

It is still a further object of the invention to provide a rapidly erectable housing unit including exterior wall sections which are afforded with openings therethrough to accommodate and provide for window and door openings.

These and other objects and advantages of the applicant's invention will more clearly appear from a consideration of the accompanying drawings and disclosure.

DETAILED DISCLOSURE OF THE INVENTION

As stated in the Objects of the Invention, the intention of the disclosure is to provide a rapidly erectable housing unit which includes for the interlocking aspect of various wall sections. The disclosure maintains this continuity and provides for a variety of interlocking, connective arrangements. The disclosure provides for a single or multi room unit and therefore illustrates several forms which are all consistent with the objects of the invention.

Figure 1:
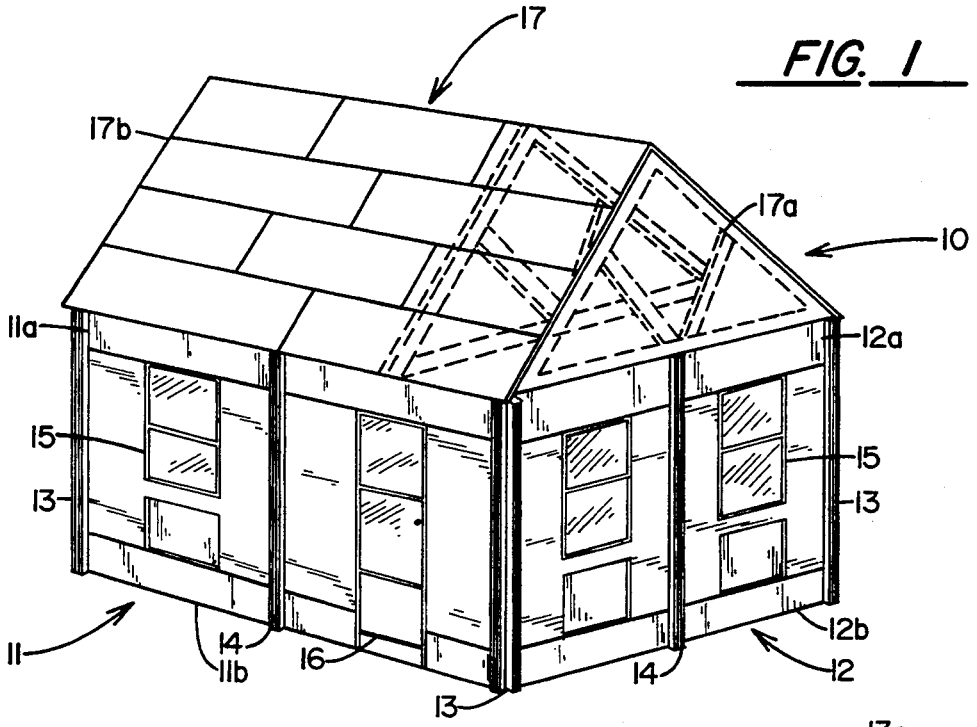
FIG. 1 is a perspective view of a typical unit embodying the conepts of the applicant's invention.

A finished housing unit 10 is illustrated in FIG. 1 which includes a side wall 11, an end wall 12, connective corner units 13, interior wall connective elements 14, windows 15, a door 16 and a total roof structure 17. Both walls 11, 12 are provided with upper headers 11*a*. 12*a* and lower base members 11*b*, 12*b*. The roof structure includes trusses or rafters 17*a* (in phantom or hidden lines) and an overlayment 17*b* of single sheets. This view represents a typical end result of the practiced invention.

Figure 2:
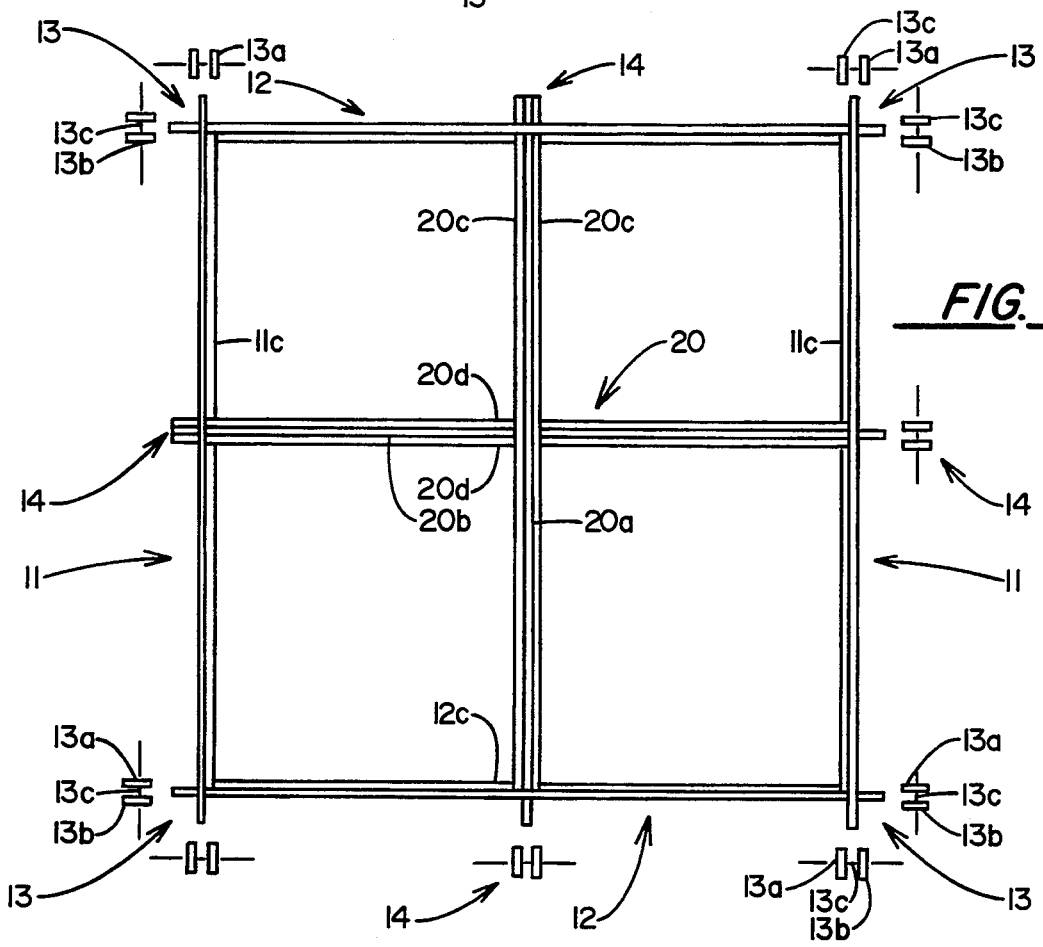
FIG. 2 is a top plan view of a joinded wall structure without roof showing a layout for a multi-room unit.

FIG. 2 illustrates a typical multi-room unit as it woulld appear prior to roof 17 installation and illustrates certain aspects of the vertical wall assembly. This view also illustrates the center wall 20 arrangement which will be discussed witih regards to FIGS. 4, 5 and 6. As illustrated in FIG. 2 the center wall unit 20 consists of a pair of wall units such as in FIGS. 4, 5 and 6 and which are designated 20*a*, 20*b*. As illlustrated in FIGS. 5 and 6, these walls 20*a*, 20*b* are initially joined through a joinder slot system in which a lower, downwardly directed slot 21*a* is interfitting with an upwardly directed slot 21*b* in the respective walls 20*a*, 20*b*. This enables the two walls to be effectively joined. These walls are also provided with upper support headers 20*c*, 20*d* on both sides thereof and lower plates 20*e*, 20*f*, again on both sides thereof. The headers and plates are simply for strength purposes and are a matter of choice. As also illstrated, tenon arrangements 30*a*, 30*b* are respectively provided on the ends of the walls 20*a*, 20*b*. The differences in the tenon structures 30*a*, 30*b* will be explained hereinafter.

Figure 3:
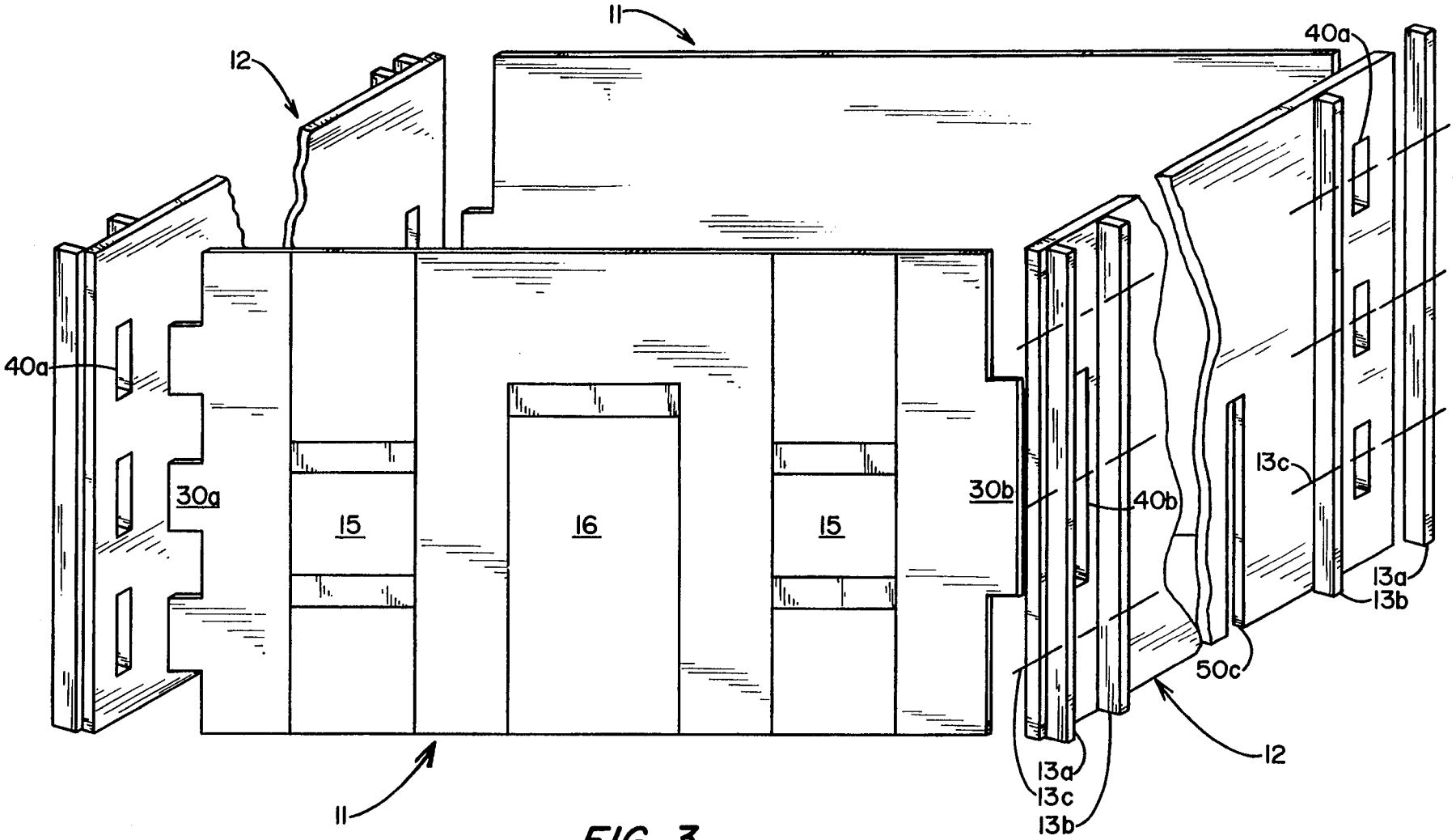
FIG. 3 is a perspective view illustrating an exterior wall structure with various forms of joinder being illustrated.

As illustrated in FIG. 3, each of the side 11 walls are provided with a similar set of tenons 30*a*, 30*b* while end walls 12 are provided with mortise openings 40*a*, 40*b*. Obviously, the aspect of the mortise-tenons is to provide a first interlock feature between side walls 11, end walls 12 and the walls 20*a*, 20*b* which form the interior partion 20. FIG. 2 also illustrates that side walls 11 and end walls 12 may be provided with internal headers 11*c*, 12*c* as well as the headers 11*a*, 12*a* as illustrated in FIG. 1.

Obviously with a mortise-tenon as illustrated, the units may be so sized as to provide extensions through the interlocked areas, As illustrated in FIG. 2, the corner interlock is achieved with lock units 13 each of which includes a pair of elments 13*a*, 13*b* which will engage such extensions and lie thereagainst to allow a connective elemenet 13*c* such a bolt, screw or the like to pass through all three units and therefore provide a positive stop for locking the mortise-tenons together. This same structure and arrangement is available for locking the tenons of interior walls 20*a*, 20*b* to the exterior side or end walls 11, 12.

It should be obvious that the locking units 13*a*, 13*b* and connector 13*c* could be provided on only the extending tenon portion which would pass through the mortise to hold the tenon tightly against the mortised member. This is a matter of choice and would be controlled by strength desired in the final unit.

Figure 7:
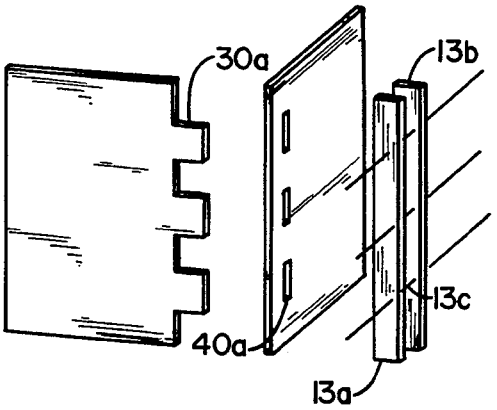
FIG. 7 is a more detailed view of a mortise-tenon joinder.
Figure 8:
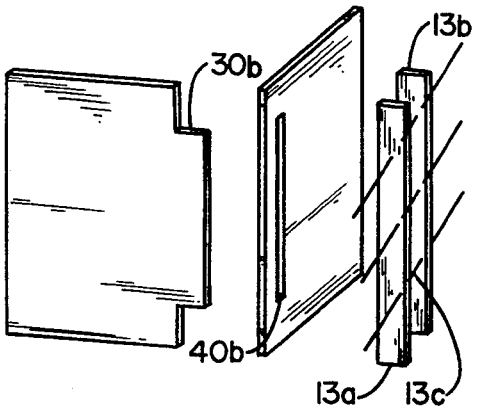
FIG. 8 is another form mortise-tenon joinder.

FIGS. 7 and 8 illustrate this mortise-tenon arrangement utilizing the same numerals while illlustrating only the locking elements 13*a*, 13*b*, 13*c* to connect to the tenon as described hereinabove. These views illustrate a single and multiple tenon system.

Figure 4:
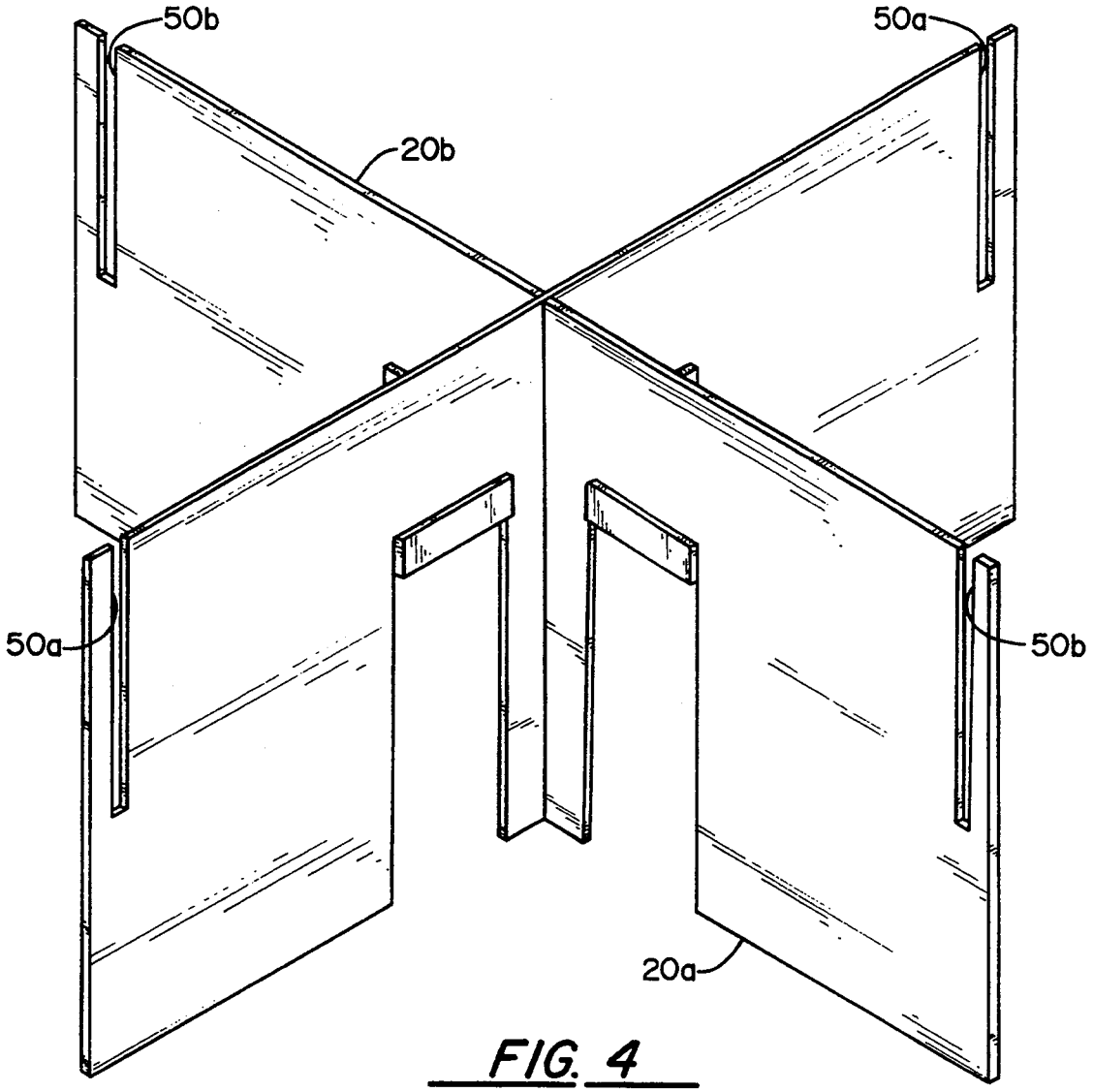
FIG. 4 is a perspective view illustrating one particular interior wall arrangement a one joinder method which is related to one form of exterior wall joinder.

One additional form of interlock arragement is best illustrated in the partition walls of FIG. 4 and end wall 12 of FIG. 3. This same type of interlock is illustrated in FIGS. 5 and 6 wherein the sliding fits of slots 21*a* , 21*b* were discused and described.

Both the wall sections 20*a*, 20*b* are provided with vertical slots 50*a*, 50*b* while side wall 12 is illustrated with a corresponding slot 50*c*. It should be obvious to anyone skilled in the art that these slots are interfitting and therefore lockable into one another to provide a stable connection. Such a connection could be utilized to place and locate either one or both of the inner partitions to the side 11 and end 12 walls and eliminate the mortise-tenon connection between partition and exterior walls.

Figure 5:
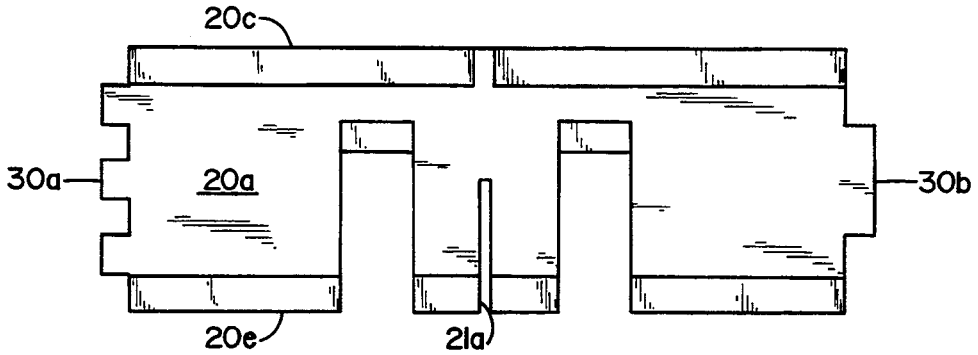
FIG. 5 is an elevation of one form of interior wall section.
Figure 6:
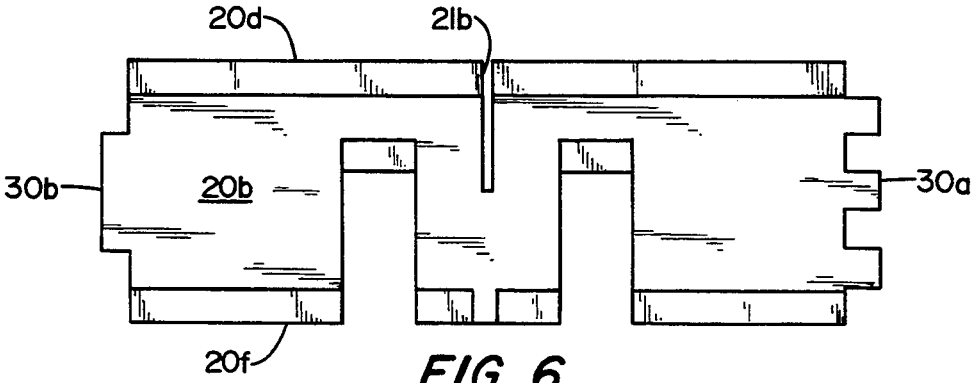
FIG. 6 is an elevation of another form of interior wall section which would cooperate with that of FIG. 5 as well a exterior walls.

If the election in erecting the unit is to utilize the partition walls, it should be obvious that passage doorways must be provided therethroug as in FIGS. 5 and 6. It should also be obvious that the tenons of the partition walls could be eliminated and other means of attachment to the interior of the exterior walls 11,12 could be utilized.

As illustrated throughout the several views, the primary portions of the walls may be relatively thin in cross-section with additional strength being obtained through an appropriate header and if necessary base plate addition.

Applicant is aware that an advantage of his invention is that of on site manufacturer through the use of local materials. In experimentation, applicant has found that such wall panels, headers and the like may be formed by using local material such as grasses, wood particles and the other such materials which are then bound through various water resistant materials and even pressed to their flat condition through the use of relatively primitive practices such as positioning the material on a flat surface and thereafter covering the positioned material with another flat surface and pressing the same through any available weight. Obviously such processes may only find their applications in isolated areas and, perhaps, areas of particularly low income but this aspect is of import in considering the worth of any invention. It is definitely cost saving and should be considered as an attribute of invention.

It should be obvious that the applicant has provided a new and unique aspect of housing units that he does not consider to be known to the prior patented nor commercial art.

What is claimed is:

1. A rapidly erectable housing unit including:

a. a pair of vertically positionable side walls, each having a pair of opposite ends;

b. a pair of vertically positionable end walls, each having a pair of opposite ends;

c. mortise and tenon structures provided on respective ends of said side walls and said end walls to provide means for joining said ends of said side walls to ends of said end walls.

d. said tenon structures extending through said mortise structures;

e. clamp means attachable to said extending tenon structures and abutting the area adjacent said mortise structures to provide a positive locking effect thereto preventing removal of said tenon structure from said mortise structure, and, f. a roof structure positionable over said joined walls to provide a covering for the area defined by said joined side and end walls.

2. The rapidly erectable housing unit as set forth in claim 1 wherein said ends of said side walls are provided with said tenon structures and said ends of said end walls are provided with said mortise structures.

3. The rapidly erectable housing unit as set forth in claim 1 wherein said ends of said end walls are provided with said tenon structures and said ends of said end walls are provided with said mortise structures.

4. The rapidly erectable housing unit as set forth in claim 1 wherein:

a. each of said side walls is provided with an upper and a lower edge and a downwardly directed slot provided in said side walls extending from said upper edge thereof b. said slot being provided approximately intermediate said ends of said side walls; and, c. a first intermediate wall having an upper and a lower edge and being of a length equal to the length of said end walls to extend between said positioned side walls and having an upwardly directed slot adjacent the ends thereof such that said first intermediate wall is receivable and positionable within said upwardly extending slot of said side walls whereby said area is divided into two substantially equal areas.

5. The rapidly erectable housing unit as set forth in claim 4 and an opening formed in said first intermediate wall to permit a person to pass therethrough.

6. The rapidly erectable housing unit as set forth in claim 4 and a downwardly directed slot being formed in said first intermediate wall arranged and constructed to receive a second intermediate wall extending between said end walls whereby said defined area is divided into four, substantially equal areas.

7. The rapidly erectable housing unit as set forth in claim 6 end openings formed in said first intermediate and second intermediate walls to permit persons to pass therethrough.

8. The rapidly erectable housing unit as set forth in claim 6 and said second intermediate wall including an upwardly directed slot to provide a slotted joinder between said first intermediate and second intermediate walls.

9. The rapidly erectable housing unit as set forth in claim 5 wherein;

a. said end walls are provided with an upper and a lower edge;

b. slot means extending downwardly from said upper edges of said end walls, intermediate said ends thereof;

c. said second intermediate wall being provided with upwardly directed slots adjacent said ends thereof and intermediate said ends thereof;

d. said second intermediate wall being positionable within said slots of said end walls and said first intermediate wall.

* * * * *